United States Patent [19]

Schoppee

[11] 4,070,851

[45] Jan. 31, 1978

[54] GUM STICK WRAPPING MACHINE

[75] Inventor: Lawrence W. Schoppee, Springfield, Mass.

[73] Assignee: Package Machinery Company, East Longmeadow, Mass.

[21] Appl. No.: 698,957

[22] Filed: June 23, 1976

[51] Int. Cl.[2] ..... B65B 11/46

[52] U.S. Cl. ..... 53/228; 225/104

[58] Field of Search ..... 53/176, 228, 229, 230, 53/231, 232, 233; 225/97, 103, 104

[56] References Cited

U.S. PATENT DOCUMENTS

| | | | |
|---|---|---|---|
| 1,185,822 | 6/1916 | Price | 53/176 X |
| 1,491,970 | 4/1924 | Price | 53/176 |
| 2,029,934 | 2/1936 | Milmore | 53/234 X |
| 2,968,139 | 1/1961 | Mehlhorn | 53/230 X |
| 3,099,375 | 7/1963 | Schoppee et al. | 225/97 |

FOREIGN PATENT DOCUMENTS

| | | | |
|---|---|---|---|
| 2,433,547 | 1/1976 | Germany | 225/97 |

*Primary Examiner*—Othell M. Simpson
*Assistant Examiner*—John Sipos
*Attorney, Agent, or Firm*—McCormick, Paulding & Huber

[57] ABSTRACT

A single gum stick wrapping machine includes a gum breaking mechanism for separating prescored slabs of gum into individual sticks. A transport mechanism, which receives the gum from the breaking mechanism and intermittently advances it along a horizontal path through a plurality of folding stations, includes a walking beam transport, which reaches into the breaking mechanism and extracts each successive stick as it is separated from a slab. Long seam folding operations are completed by a pocket wheel and an associated transport which delivers the sticks in stacked relation at a collection point at the discharge end of the machine.

16 Claims, 18 Drawing Figures

GUM STICK WRAPPING MACHINE

BACKGROUND OF THE INVENTION

This invention relates in general to packaging machinery and deals more particularly with an improved single stick wrapping machine particularly adapted for wrapping sticks of gum.

In the gum packaging art, the development of improved high speed apparatus and methods for trimming and scoring gum slabs has created a need for improved high speed stick wrapping machinery for receiving and further processing trimmed prescored slabs delivered by such trimming and scoring mechanism. Gum stick packaging lines have heretofore generally included a gum stick breaking device which has its own conveying mechanism for advancing sticks separated by the breaking device to a transport mechanism associated with a stick wrapping machine. A typical breaking device of the aforedescribed general type is shown and described in U.S. Pat. 3,099,375 to Schoppee et al issued July 30, 1963. It is the general aim of the present invention to provide an improved single gum stick wrapping machine wherein a gum breaking mechanism comprises an integral part of the wrapping machine thereby reducing substantially the cost of producing such a machine and the factory floor space requirements necessary to accommodate it.

SUMMARY OF THE INVENTION

In accordance with the present invention, an improved single gum stick wrapping machine is provided which comprises a gum breaking mechanism for separating prescored slabs of gum into individual sticks, a transporting and folding mechanism including a walking beam transport for receiving each stick from the breaker mechanism at the point of stick separation, withdrawing each separated stick from the breaker mechanism and further advancing it along a generally horizontal feed path, means for positioning the wrapper in the path of each successive stick advanced by the transport mechanism, means for forming a wrapper around the stick as it is advanced by the transporting and folding mechanism, and at least one folding means associated with the transporting and folding mechanism for folding a wrapper formed about the stick as the stick and its associated wrapper are advanced through the machine toward a collection point at the discharge end of the machine by the walking beam transport.

DETAILED DESCRIPTION OF PREFERRED EMBODIMENT

Figure 1:
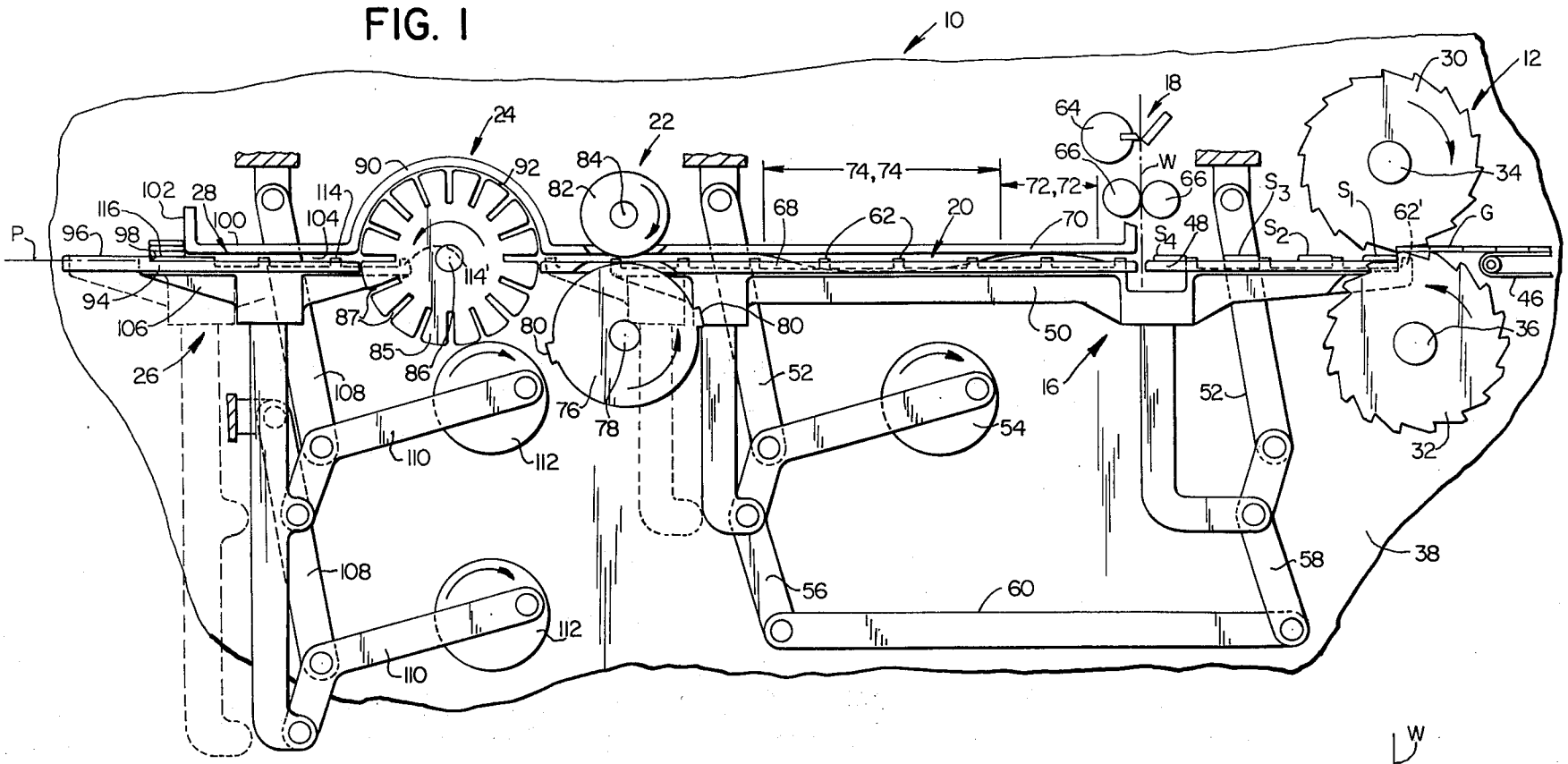
FIG. 1 is a somewhat schematic fragmentary side elevational view of a single gum stick wrapping machine embodying the present invention.
Figure 2:
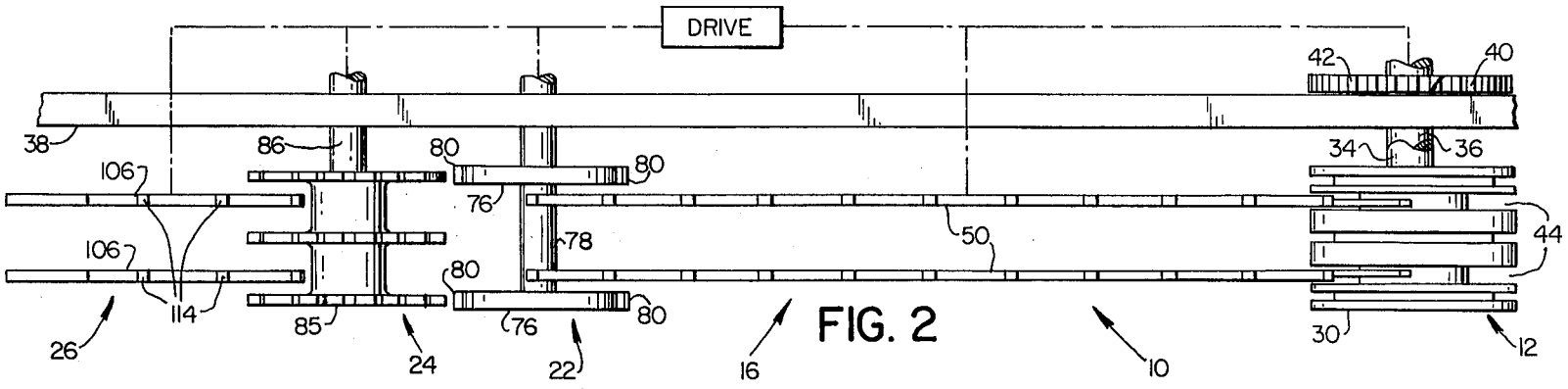
FIG. 2 is a somewhat schematic fragmentary plan view of the machine of FIG. 1 and shows the relative position of the various machine elements, the folding channels not being shown.

Turning now to the drawings, the diagramatic views of FIGS. 1 and 2 illustrate a single gum stick wrapping machine embodying the invention and indicated generally by the reference numeral 10. The machine 10 comprises a breaker mechanism designated generally by the numeral 12 which receives a substantially continuous supply of prescored slabs of gum, such as the slab G shown in FIG. 1, and separates each slab along score lines into individual sticks. A gum stick transport mechanism which includes a walking beam transport 16 engages each successive stick separated by the breaker mechanism 12, withdraws it from the breaker mechanism, and intermittently conveys it along a generally horizontal path P. As each stick is advanced by the transport 16 it picks up a wrapper W at a wrapper feed station indicated generally at 18 and enters a folding channel designated generally by the numeral 20 wherein the wrapper is partially formed around the stick in a series of successive folding operations hereinafter further described. The machine 10 further includes a creasing mechanism 22 which engages each partially wrapped stick as it is conveyed through the folding channel 20 and performs creasing operations thereon. Final folding operations are performed by a rotary folder indicated generally at 24, which comprises a part of the transport mechanism, and another walking beam transport 26 which conveys the partially wrapped stick into and through another folding channel indicated generally at 28 to a collection point at the discharge end of the machine.

Considering the machine 10 in further detail, the breaker mechanism 12 comprises a pair of toothed breaker wheels which includes an upper breaker wheel 30 and a lower breaker wheel 32 respectively secured to shafts 34 and 36 journalled for rotation about horizontal axes on a machine frame indicated at 38. Meshing gears 40 and 42 of equal size are respectively secured to the shafts 34 and 36 so that the wheels 30 and 32 will rotate at the same peripheral rate with the teeth thereof in intermeshing relation. At least the lower breaker wheel 32 has axially spaced annular grooves formed therein, but preferably and as shown both wheels 30 and 32 are respectively formed with annular grooves 44, 44, as shown in FIG. 2. Appropriate support plates and hold-down platforms (not shown) may be provided which may extend into the grooves 44, 44 to aid in guiding gum into and through the breaker mechanism 12, however, for clarity of illustration these structures are not shown. Any suitable feed mechanism may be employed for feeding prescored slabs, such as the slab G, into the nip formed between the breaker wheels 30 and 32 in timed relation to rotation of the breaker wheels. In the illustrated embodiment 10 a conveyor 46 is provided for this purpose. A more complete disclosure of a breaker mechanism of the type hereinbefore described is found in U.S. Pat. No. 3,099,375 to Schoppee et al, issued July 30, 1963. Reference may be had to the aforementioned patent for further detail as to the structure and arrangement of the breaker wheels which comprise the breaker mechanism 12.

The walking beam transport 16 generally comprises a plurality of transversely spaced apart gum support plates, such as the plate 48 shown in FIG. 1, mounted in fixed position on the frame 38. The latter plates have upwardly facing surfaces arranged in a horizontal plane to define a portion of the gum feed path P. The transport 16 further includes a pair of transversely spaced transport plates 50, 50 supported to rock on parallel links 52, 52 and connected to an eccentric drive member 54 through another linkage comprising the links 56, 58 and 60. Each plate 50 has a plurality of upwardly projecting pusher fingers 62, 62. The transport plates 50, 50 are supported for limited forward movement with the fingers 62, 62 disposed above the level of the path P and for return or rearward movement with the fingers 62, 62 disposed below the level of the path P, as is well known in the art. The rearmost pusher finger designated 62' is disposed rearwardly of the nip formed by the upper and lower breaker wheels 30 and 32 when the transport mechanism 16 is in its rear or full line position of FIG. 1. The eccentric drive element 54 is driven in timed relation to the breaker mechanism to cause the finger 62' to engage the trailing edge each successive stick S separated by the breaker mechanism 12 approximately at the point at which the interdigitation teeth which form the nip begin to separate from each other and to withdraw the stick from the breaker mechanism and advance it along the path P, the forward position of the transport 16 being shown in broken lines.

The wrapper feed mechanism 18 is located above and immediately forward of the gum support plates 48, 48 and comprise a rotary cutter indicated generally at 64 driven in timed relation to the wrapping machine 10 to sever a wrapper of required length from a continuous web of foil sulfide paper or like material. The feed mechanism 18 further includes a pair of feed rolls 66, 66 for feeding the wrapper W into the path of a stick S advanced by the transport 16. The folding channel 20 is positioned forward of the feed mechanism 18 and comprises a plurality of transversely spaced apart lower gum support plates 68, 68. The upper surfaces of the plates 68, 68 cooperate to further define the path P. An upper portion of the channel 20 is formed by one or more plates such as the plate 70, FIG. 1, spaced above the plates 68, 68. Folding ramps or plows 72, 72 of a type well known in the packaging art are mounted in fixed position at transversely opposite sides of the folding channel 20 for engaging and folding opposite end portions of a wrapper, as will be hereinafter further discussed. Conventional spiral folders 74, 74 are also mounted in fixed position at opposite sides of the folding channel 20 forward of the plows 72, 72 for performing a further folding and tucking operation on each partially wrapped stick as it is advanced within the channel 20 by the transport 16, as will be hereinafter further described.

Considering now the creasing mechanism 22, this mechanism includes a pair of axially spaced apart creasing wheels 76, 76 secured in axially spaced relation to a shaft 78 journalled for rotation about a horizontal axis on the frame 38 below the path P and driven in timed relation to the various other mechanisms which comprise the machine 10. Each creasing wheel 76 has a pair of diametrically opposed arcuate peripheral segments which define a pair of creasing shoes 80, 80 on its outer peripheral surface. The pair of opposing backup wheels 82, 82 are supported above the wheels 80, 80 respectively by a shaft 84 journalled on the frame 38. The backup wheels 82, 82 are arranged in general in-running relation to the creasing shoes 80, 80 to engage the wrapper W on a partially wrapped stick advanced within the folding channel 20.

The rotary folding mechanism 24 comprises a pocket wheel 85 supported by a shaft 86 journalled on the frame 38 for rotation about a horizontal axis disposed generally within the path P and defines a plurality of radially outwardly opening article receiving pockets 87, 87. The illustrated pocket wheel 85 has 16 pockets and is arranged for intermittent rotation in timed relation to the cycle of the transport 16. In accordance with the presently preferred embodiment of the invention the pocket wheel 85 is further arranged for 270° motion and 90° dwell. One or more generally semi-circular top plates such as the plate 90, FIG. 1, extend around the upper portion of the pocket wheel 85 and cooperate with the peripheral portions of the pocket wheel 85 to define a second folding channel 92.

A plurality of lower gum support plates 94, 94 are positioned immediately forward of the pocket wheel 85 and have upwardly facing surfaces which define a further portion of the path P. At its forward end each plate 94 has another upwardly facing surface 96 spaced above the path P a distance substantially equal to the thickness of a single stick S and a rearwardly facing stick abutment surface 98. One or more top plates such as the plate 100, FIG. 1, are spaced above the plate 94, 94 and extend in a forward direction from the plate 90 and define a forwardly facing abutment 102. The bottom plates 94, 94 and the top plate 100 cooperate to form a third folding channel 104. The transport 26 comprises a walking beam mechanism which includes a pair of transport members 106, 106 supported in transversely spaced relation by a pair of parallel links 108, 108 and connected by further links 110, 110 to eccentric drive elements 112, 112. Each transport member 106 has a plurality of upwardly spaced pusher fingers 114, 114 arranged for forward motion above the path P and return motion below the path, as is well known in the art. The rearmost fingers designated 114', 114' are arranged to engage the trailing edge of a partially wrapped stick within the pocket wheel 85 to withdraw the stick from the pocket wheel and move it into the folding channel 104. The forward-most portions of the transport members 106, 106 have upwardly facing surfaces 116, 116 which cooperate to define a platform for elevating each successive stick S to permit the next stick to move thereunder thereby constituting a stacking mechanism at a collection point between the abutment surfaces 98 and 102 at the discharge end of the machine.

Figure 3:
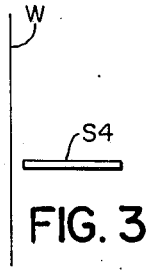
FIGS. 3–10 are side elevational views diagramatically illustrating successive steps in wrapping a single stick of gum.
Figure 4:
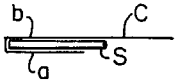
Figure 5:
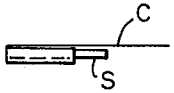
Figure 6:
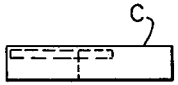
Figure 7:
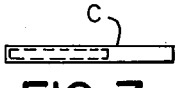
Figure 8:
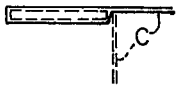
Figure 9:
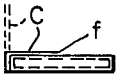
Figure 10:
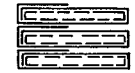
Figure 11:
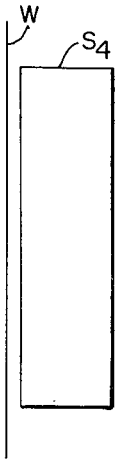
FIGS. 11–17 are plan views diagramatically illustrating successive steps in the wrapping of a single stick of gum.
Figure 12:
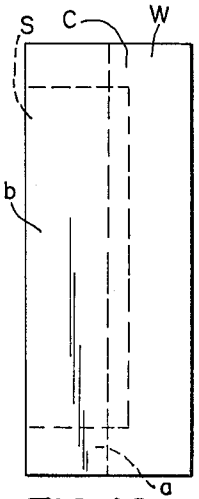
Figure 13:
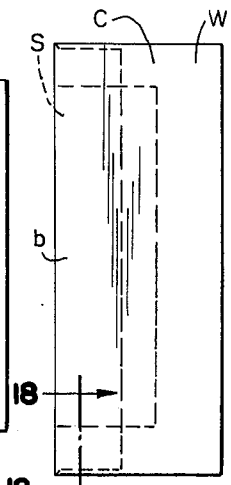
Figure 14:
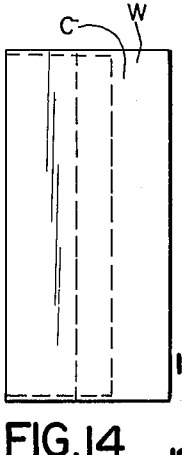
Figure 15:
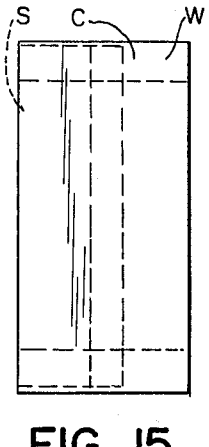
Figure 16:
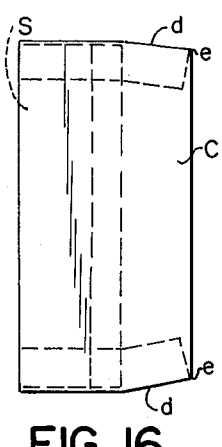
Figure 17:
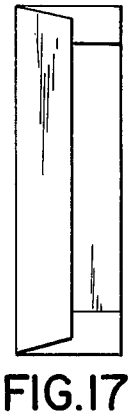
Figure 18:
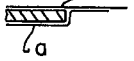
FIG. 18 is a fragmentary sectional view taken along the line 18, 18 of FIG. 13.

In FIG. 1 the machine 10 is illustrated as it appears after the fourth operational cycle with sticks at positions designated $S_1$–$S_4$. A stack of sticks is shown at the discharge end of the machine to illustrate the stacking function of the transport mechanism 26. As a prescored slab G is fed into the breaker mechanism 12 by the conveyor 46 the intermeshing teeth on the breaker wheels 30 and 32 engage the slab along a score line to separate a stick S from the slab. A tooth on the lower wheel 32 continues to advance the separated stick as it emerges from the nip between the upper and lower breaker wheels. As the stick approaches position $S_1$, shown in FIG. 1, the transport 16 is completing its return stroke so that the finger 62' moves into position behind the stick $S_1$ to engage the trailing edge of the stick, withdraws it from the breaker mechanism 12 and advances it to position $S_2$. The stick at position $S_2$ is simultaneously advanced to position $S_3$ etc. During the return cycle of the transport 16 the wrapper feed mechanism 18 severs a wrapper W from an associated web and feeds it to the position shown in FIG. 1 immediately forward of the stick at position $S_4$ as shown in FIGS. 1, 3 and 11. Considering now the wrapping operations and referring particularly to FIGS. 1 and 3–18, during the next machine cycle the transport 16 advances the stick at position $S_4$ causing the leading edge of the stick to engage the wrapper W and carry it to the folding channel 20. Opposing upper and lower walls of the folding channel 20 engage the wrapper W to fold it to a generally U-shaped configuration about the advancing stick and into the form shown in FIGS. 4 and 12. Still referring to the latter figures, it will be noted that the lower portion of the wrapper W designated *a* is folded against the bottom face of the stick and a mid-portion of the wrapper, designated *b*, is folded against the top face of the stick S to cause the wrapper upper end portion *c* to assume a trailing position rearwardly of the stick top face. It should be further noted that equal and opposite side marginal portions of the wrapper W extend outwardly in opposite directions beyond the opposite ends of the stick S as best shown in FIG. 12. In the next machine cycle the partially wrapped stick is advanced into plows 72, 72 which engage the side marginal portions of the wrapper W to fold the latter marginal portions upwardly against opposite ends of the stick S and against the lower face of the wrapper mid-portion *b*, FIGS. 5 and 13. A typical side fold as formed on the wrapper W by the plows 72, 72 is further shown in FIG. 18. During the next three successive cycles of the machine the transport 16 intermittently advances the partially wrapped stick through the spiral folders 74, 74 which engage the outwardly extending opposite marginal end portions of the wrapper W and fold these portions downwardly relative to the stick and against the opposite sides of the stick. The spiral folders further tuck the downwardly folded extensions inwardly into overlying relation with the lower face of the wrapper portion *a*. As the transport 16 further advances the partially wrapped stick S within the channel 20 the creasing shoes 80, 80 engage the trailing portions of the wrapper and tuck the inwardly folded side marginal extensions of the wrapper against the trailing edge of the stick and simultaneously crease the folds at the outer edges of the trailing portion, the latter folds being indicated at (*d, d.*) FIG. 16. This folding and creasing operation brings corners (*e, e*) of the wrapper inwardly to positions generally shown in FIG. 16. After the partially wrapped stick has been advanced beyond the creasing mechanism 22, the wrapper W has the form substantially shown in FIG. 16 and full lines in FIG. 8. The partially wrapped stick is next moved into the pocket wheel 24 by line pressure exerted by a partially wrapped stick behind it in the folding channel 20. During the return cycle of the transport 16, the pocket wheel 85 indexes in a counterclockwise direction, as viewed in FIG. 1, which causes the wrapper trailing edge portion *c* to be folded downwardly relative to the stick and against the trailing edge of the stick from its full to its broken line position of FIG. 8, as the pocket wheel 85 moves the folding channel 92. The pocket wheel 85 carries the partially wrapped stick through an angle of 180°, thereby inverting it. The transport mechanism 26 withdraws the partially wrapped stick from the pocket wheel 85 and advances it into the folding channel 104 thereby causing the wrapper trailing portion *c* to be folded from its broken to its full line position of FIG. 9, to complete the long seam of the wrapper. It will be noted that the free edge of the long seam, designated *f*, is in a trailing position when transport 26 advances the wrapped stick to the collection point. As the transport 26 moves toward its forward or broken line position of FIG. 1 it elevates the stick or sticks at the collection point and moves the next successive stick into a position below the preceding sticks so that a stack of sticks is formed. An appropriate pusher mechanism (not shown) may be provided for intermittent operation to advance a stack comprising a predetermined number of sticks into an associated packaging machine or the like which may be mounted forward of the machine 10 to receive the sticks therefrom.

I claim:

1. A gum stick wrapping machine comprising a gum breaking mechanism for separating prescored slabs of gum into individual sticks and including upper and lower toothed breaker wheels journalled for rotation about parallel axes with the teeth thereof in intermeshing relation to form a nip therebetween and means for rotating said breaker wheels in opposite directions at the same peripheral rates, said lower breaker wheel having an annular groove opening outwardly through its peripheral surface, means for feeding prescored slabs into said nip, a first transporting and folding mechanism including a walking beam gum stick transport for receiving each successive stick at said nip as it is separated from a slab by said breaker wheels and intermittently advancing it along a generally horizontal straight line feed path, said walking beam gum stick transport being supported forwardly of said breaker wheels for reciprocal movement in a generally orbital path of travel toward and away from said breaker wheels between forward and rear positions, respectively, and having a finger thereon positioned within said annular groove rearwardly of said nip when said walking beam gum stick transport is in its rear position for engaging a stick upon its separation from a slab at said nip to withdraw the stick from the breaker mechanism and advance it along said feed path, said transporting and folding mechanism including a folding channel for receiving a wrapper and a stick advanced by said walking beam gum stick transport and forming a portion of the wrapper to a generally U-shaped configuration about the stick, said transporting and folding mechanism having at least one folding means associated with said folding channel for engaging and folding a wrapper formed about a stick as the stick and its associated formed wrapper are advanced within the folding channel by said walking beam gum transport, and means for positioning a wrapper in the path of a stick advanced by said walking beam gum stick transport.

2. A gum stick wrapping machine as set forth in claim 1 wherein said lower breaker wheels has a plurality of axially spaced apart annular grooves formed therein, said walking beam gum stick transport comprises a plurality of transversely spaced apart gum support plates, each of each said support plates has a finger at the rear end portion thereof, and each of said fingers is disposed in an associated one of said grooves when said walking beam gum stick transport is in its rear position.

3. A gum stick wrapping machine as set forth in claim 1 wherein said folding channel comprises a plurality of plates including a plurality of transversely spaced apart and horizontally disposed lower gum support plates defining a portion of said path and at least one upper plate disposed above said lower gum support plates.

4. A gum stick wrapping machine as set forth in claim 1 wherein said one folding means comprises means for engaging extending opposite side marginal portions of the wrapper as the partially wrapped stick is advanced within said folding channel and folding lower side marginal portions of the wrapper upwardly against opposite ends of the stick and against the lower face of the upper side marginal portions of the wrapper.

5. A gum stick wrapping machine as set forth in claim 4 wherein said one folding means comprises forwardly converging ramps at opposite sides of said folding channel for engaging outwardly extending side marginal portions of the wrapper as the partially wrapped stick advances within said folding channel.

6. A gum stick wrapping machine as set forth in claim 1 wherein said one folding means comprises means for engaging and folding extending side marginal portions of the wrapper downwardly relative to the stick and against opposite ends thereof and tucking the side marginal portions inwardly toward each other and below the lower face of the stick as the partially wrapped stick is advanced by said transport mechanism.

7. A gum stick wrapping machine as set forth in claim 6 wherein said one folding means comprises spiral folders mounted in fixed position at opposite sides of said folding channel for engaging outwardly extending side marginal portions of the wrapper as the partially wrapped stick is advanced within the first folding channel by said gum stick transport.

8. A gum stick wrapping machine as set forth in claim 7 including a second transporting and folding mechanism for receiving each successive partially wrapped stick from said first transporting and folding mechanism and for advancing each successive stick and simultaneously folding a trailing portion of its wrapper against the stick as it is advanced.

9. A gum stick wrapping machine as set forth in claim 8 including a third transporting and folding mechanism for receiving each successive partially wrapped stick from said second transporting and folding mechanism and for simultaneously advancing each successive stick and completing the long seam of the wrapper thereon.

10. A gum stick wrapping machine as set forth in claim 6 wherein said folding means includes another folding means associated with said first folding channel for engaging trailing portions of the wrapper and folding and creasing the trailing portions upwardly relative to the stick and against the trailing edge of the stick and into face-to-face engagement with the lower surface of the trailing upper end portion of the wrapper as the partially wrapped stick is advanced within the first folding channel by said walking beam gum stick transport.

11. A gum stick wrapping machine as set forth in claim 10 wherein said other folding means comprises a rotary folding and creasing mechanism journalled for rotation about axes extending transversely of said feed path.

12. A gum stick wrapping machine as set forth in claim 11 wherein said folding and creasing mechanism comprises a pair of coaxially supported and axially spaced apart creasing wheels disposed at opposite sides of said folding channel, each of said creasing wheels having circumaxially spaced arcuate peripheral segments defining creasing shoes for engaging trailing marginal portions of the wrapper of the partially wrapped stick as it advances within said folding channel.

13. A gum stick wrapping machine as set forth in claim 8 wherein said second transporting and folding means comprises a rotary folding element.

14. A gum stick wrapping machine as set forth in claim 13 wherein said rotary folding element comprises a pocket wheel having a circumaxial series of radially outwardly opening stick receiving pockets and means defining an arcuate folding channel having its center of curvature generally coincident with the axis of said pocket wheel and generally complementing an associated peripheral portion of said pocket wheel.

15. A gum stick wrapping machine as set forth in claim 9 wherein said third transporting and folding means comprises means defining another folding channel and another gum stick transport for moving the partially wrapped stick into and advancing it in said other folding channel.

16. A gum stick wrapping machine as set forth in claim 15 wherein said other gum stick transport comprises a walking beam transport mechanism.

* * * * *